United States Patent [19]

Grecksch et al.

[11] Patent Number: 5,033,623

[45] Date of Patent: Jul. 23, 1991

[54] METHOD AND APPARATUS FOR ASSOCIATING INFORMATION WITH A TEXTILE PACKAGE

[75] Inventors: Hans Grecksch, Monchengladbach; Gregor Kathke, Viersen, both of Fed. Rep. of Germany

[73] Assignee: W. Schlafhorst & Co., Fed. Rep. of Germany

[21] Appl. No.: 440,666

[22] Filed: Nov. 22, 1989

[30] Foreign Application Priority Data

Apr. 15, 1989 [DE] Fed. Rep. of Germany ..... 3912488

[51] Int. Cl.[5] ..... B07C 5/02

[52] U.S. Cl. ..... 209/3.3; 209/538; 209/569; 209/927; 242/35.5 A

[58] Field of Search ..... 209/3.1, 3.2, 3.3, 540, 209/538, 569, 583, 927; 242/35.5 A

[56] References Cited

U.S. PATENT DOCUMENTS

| | | | |
|---|---|---|---|
| 3,920,124 | 11/1975 | Patterson | 209/583 |
| 4,182,452 | 1/1960 | Hulscher | 209/569 |
| 4,720,967 | 1/1988 | Gütler | 242/35.5 A X |
| 4,747,482 | 5/1988 | Sanno | 242/35.5 A X |
| 4,824,349 | 4/1989 | Oku et al. | 209/3.3 X |
| 4,854,453 | 8/1989 | Ueda et al. | 209/583 |
| 4,919,799 | 4/1990 | Menardi et al. | 209/583 X |

FOREIGN PATENT DOCUMENTS

| | | | |
|---|---|---|---|
| 3344473 | 6/1984 | Fed. Rep. of Germany | 209/927 |
| 3322193 | 1/1985 | Fed. Rep. of Germany | 209/583 |
| 3627586 | 3/1987 | Fed. Rep. of Germany A | 242/35.5 |
| 119623 | 9/1980 | Japan | 209/927 |

*Primary Examiner*—Johnny D. Cherry
*Assistant Examiner*—Gary C. Hoge
*Attorney, Agent, or Firm*—Shefte, Pinckney & Sawyer

[57] ABSTRACT

A memory chip for storing information relating to an individual textile package and a device for manipulating the package and a chip reading device to access the information stored on the memory chip are provided. The memory chip can be loaded with individual package information such as, for example, the time, date and machine location at which the package was produced and the information can preferably be extinguished from the memory chip for loading of the memory chip with individual information concerning another package. To this end, the memory chip is preferably removably secured to the textile material or the tube of the textile package for subsequent removal for reuse on another package. The manipulating device moves the package and the chip reading device relatively to one another so that the chip reading device enters a reception area of predetermined size and location relative to the memory chip in which it can read, extinguish or supplement the information stored on the memory chip.

22 Claims, 5 Drawing Sheets

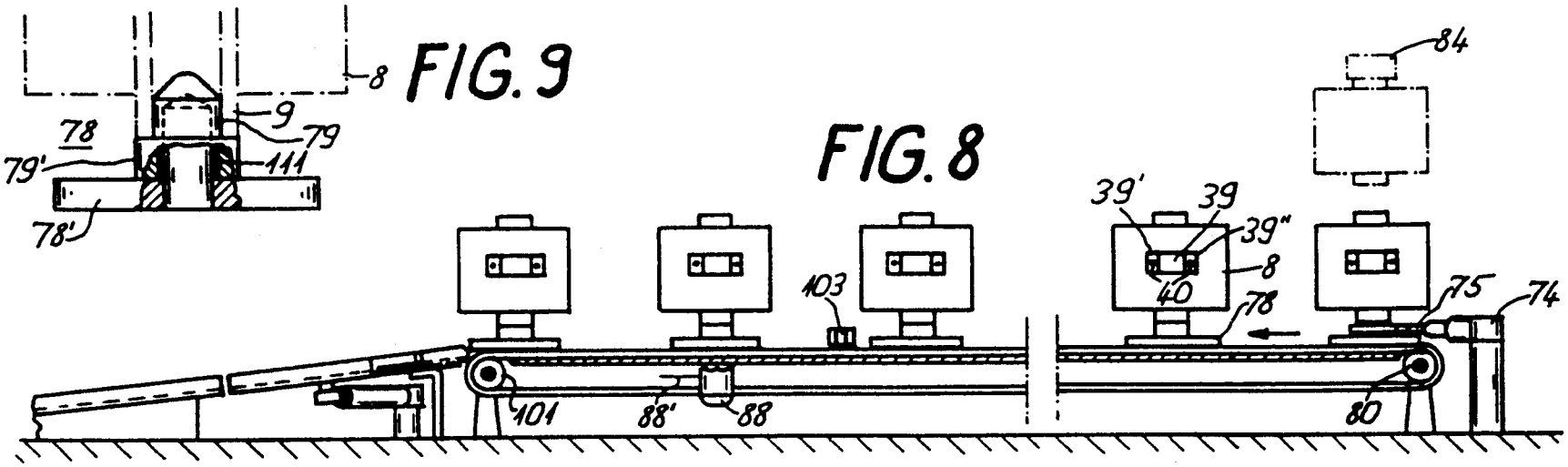
FIG. 8
FIG. 9
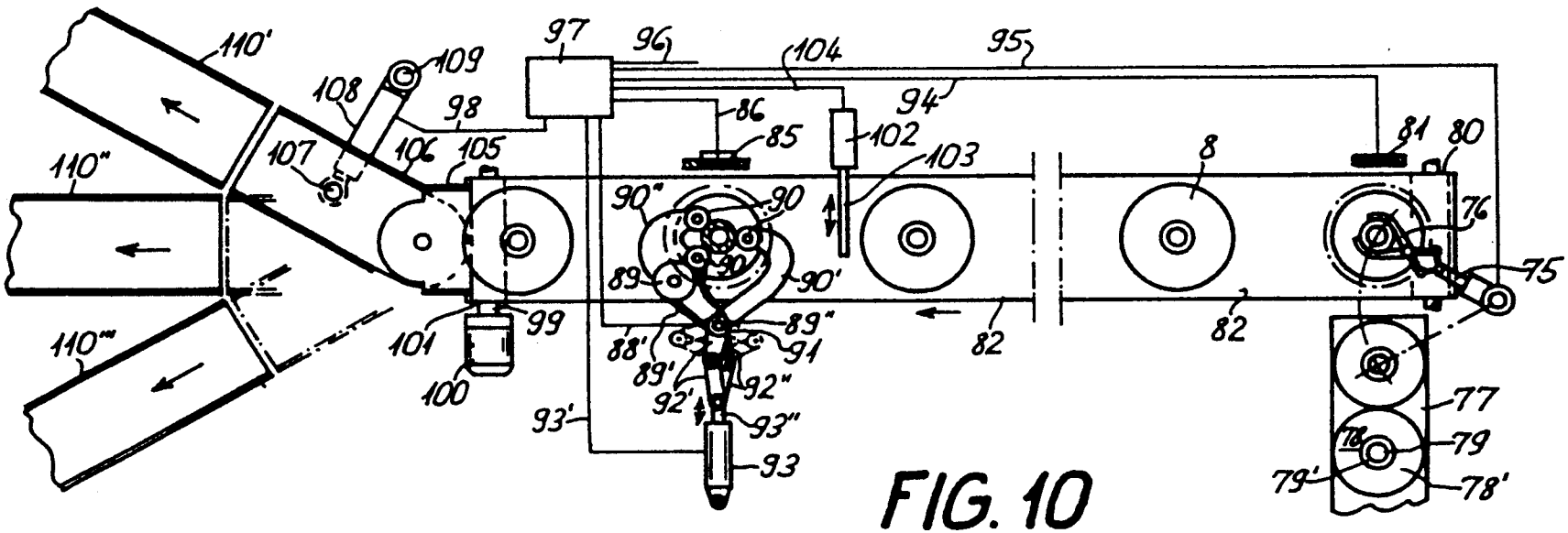
FIG. 10

METHOD AND APPARATUS FOR ASSOCIATING INFORMATION WITH A TEXTILE PACKAGE

BACKGROUND OF THE INVENTION

The present invention relates to a method and apparatus for associating information with a particular package of textile material on a textile machine and, more particularly, to a method and apparatus for storing and accessing information relating to a particular package on a memory chip.

In Swiss Patentschrift 410 718, a method is disclosed for securing a magnetic means to the tube of a textile package, the magnetic means being adapted to carry information relating to the particular package on which it is secured. However, problems arise in accessing the encoded information on the magnetic means since the magnetic means must typically be positioned within a few micrometers of the device for accessing the magnetically stored information to effectively access or "read" the information. In practice, conditions such as the dirt and dust, which are typically generated during textile operations, hinder the positioning of the magnetic means and its associated magnetic reading device within the narrow tolerance of a few micrometers.

SUMMARY OF THE INVENTION

The present invention provides a method and apparatus for storing information relating to a package on the package itself in which the stored information can be readily accessed even if dirt and dust are present.

Briefly described, one form of the present invention provides a manipulating apparatus for a textile machine of the type having a package of textile material disposed on a bobbin, a memory chip securable to the package for storing information associated with the package, means for securing the memory chip to the package, and means for accessing the information stored in the memory chip secured to the package, the accessing means being operable to access the stored information when the accessing means is located within a reception area of predetermined size and location relative to the memory chip. The manipulating apparatus includes means for relatively moving the package and the accessing means, and means for controlling the relative movement of the package and the accessing means to effect relative positioning of the memory chip and the accessing means to dispose the accessing means within the reception area.

In the preferred embodiment of the manipulating apparatus, the means for relatively moving the package and the accessing means is de-activated upon positioning of the memory chip and the accessing means within the reception area. According to one aspect of the manipulating apparatus, the manipulating apparatus includes means for loading information in the memory chip prior to securement of the memory chip on the package.

According to another form of the present invention, there is provided a memory chip for a textile machine of the type having a package of textile material disposed on a bobbin, the memory chip being securable to the package for storing information associated with the package, and means for accessing the information stored in the memory chip stored in the package, the accessing means being operable to access the stored information when the accessing means is located within a reception area of predetermined size and location relative to the memory chip. The memory chip includes an accessible information storing portion and means for removably securing the memory chip to the package for subsequent removal of the chip from the package for reuse.

According to one aspect of the memory chip, the removably securing means is formed of an adhesive material. According to another aspect of the memory chip, the removably securing means includes an elongated element projecting from the chip and insertable into the textile material on the package. In this respect, the removably securing means preferably includes a mounting component for supporting the memory chip, the mounting component including portions extending beyond the memory chip for receiving the elongated element therethrough to removably secure the mounting component to the package. The present invention also provides an apparatus for associating information with a package, the package including textile material disposed on a tube or the like, including a memory chip securable to the package for storing information associated with the package; and means for accessing the stored information in the memory chip in a non-contacting manner while the memory chip is secured to the package. The apparatus includes means for inputting information into the memory chip. The inputting means inputs information into the memory chip while the memory chip is secured to the package. Alternatively, the apparatus includes means for inputting information into the memory chip when the memory chip is not secured to the package. The inputting means includes an encoding device and a decoding device, the encoding device having the capability to extinguish stored information in the memory chip and to encode additional information into the memory chip.

The apparatus also includes a device mounted to the package and operatively connected to the memory chip for operatively interconnecting the memory chip and a selected one of the encoding and decoding devices. The operatively interconnecting device includes a galvanic conductor plate having a plurality of flexible contact surfaces. The operatively interconnecting device includes a contact member extending peripherally around the tube. The peripherally extending contact member is in the form of a metal cable. The operatively interconnecting device includes a ferrite plate for mounting the memory chip thereon and a winding imprinted on the ferrite plate and the accessing means includes a transceiver winding adapted to interact with the winding on the ferrite plate in a non-contacting manner. The memory chip may be in the form of an electronically extinguishable write-read memory chip or an extinguishable and programmable memory chip having a buffered RAM capability. The memory chip can be in the form of a flexible plate.

The present invention also provides a method for use in a textile machine of the type having a package of textile material disposed on a bobbin, a memory chip securable to the package for storing information associated with the package, means for securing the memory chip to the package, means for accessing the information stored in the memory chip in a non-contacting manner with the memory chip and means for relatively moving the package and the accessing means. The method includes controlling the relative movement of the package and the accessing means to effect relative positioning of the memory chip and the accessing means to dispose the accessing means within a reception area of predetermined size and location for accessing the information stored in the memory chip.

According to one aspect of the method controlling the relative movement of the package and the accessing means includes stopping the relative movement of the package and the accessing means when the accessing means is disposed within the reception area.

According to a further aspect, the method includes loading the memory chip with information associated with the package and securing the memory chip to the package after the information has been loaded therein and directing the package to a selected one of a predetermined group of further handling locations in response to the information accessed from the memory chip by the accessing means.

BRIEF DESCRIPTION OF THE DRAWINGS

FIG. 8 is a front elevational view similar to FIG. 6, illustrating another form of the accessing device and the relative positioning means of the package information apparatus of the preferred embodiment of the present invention;

FIG. 9 is an enlarged front elevational view, partially in section, of a portion of the relative positioning means included in FIG. 8;

FIG. 10 is a plan view of the apparatus shown in FIG. 8, showing further details of the relative positioning means;

DETAILED DESCRIPTION OF THE PREFERRED EMBODIMENT

Figure 1:
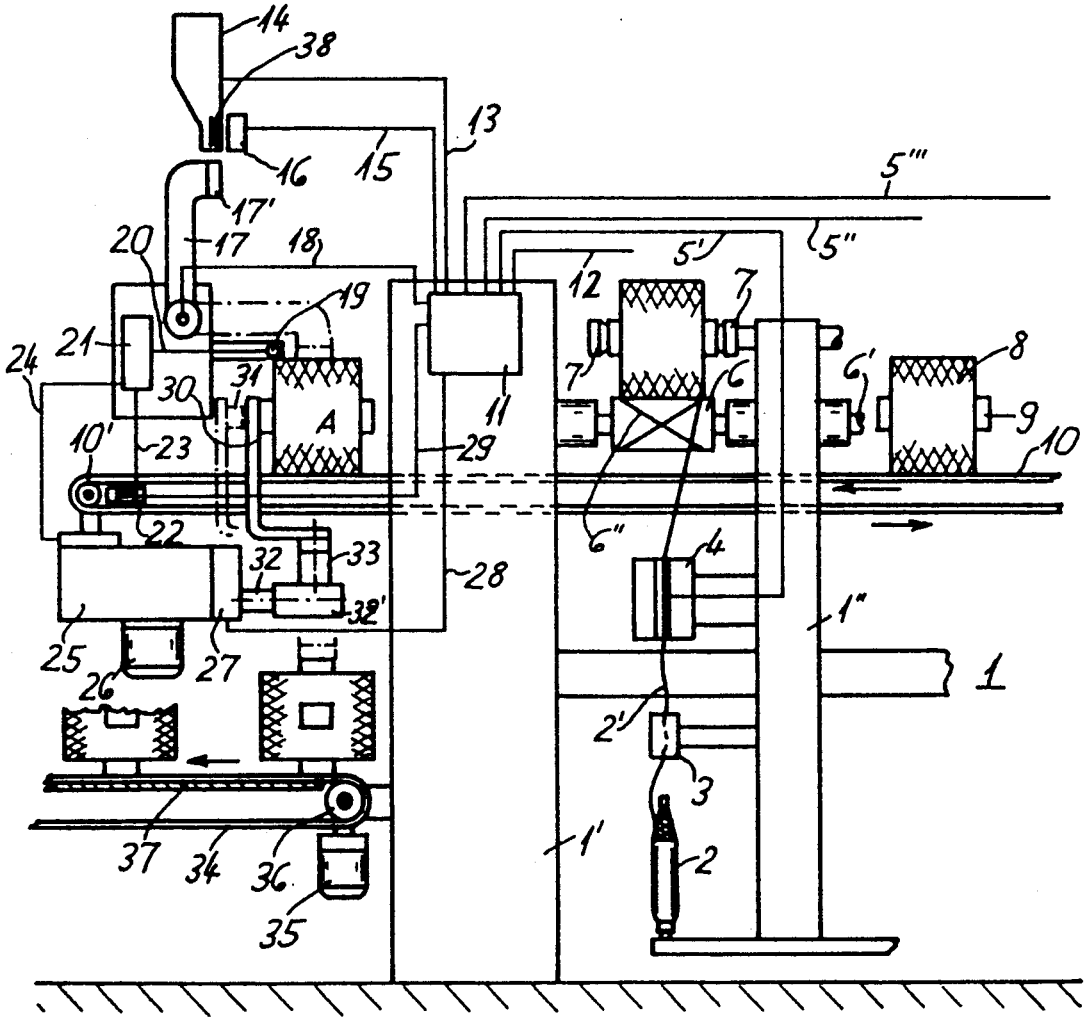
FIG. 1 is a front elevational view of a portion of a textile winding machine incorporating one preferred embodiment of the package information apparatus of the present invention.

In FIG. 1, a textile winding machine 1 is illustrated having a plurality of winding stations, only one of which is illustrated. The winding station includes a number of conventional components mounted between a frame portion 1' and another frame portion 1''. Yarn 2' is drawn at the station from a feed package 2 for winding the yarn in a cross-wound manner on a tube to build a cross-wound package 8. In conventional manner, the yarn 2' travels from the feed package 2 through a conventional yarn brake 3 and a conventional electronic yarn break monitor 4 to a yarn guide drum 6 for guiding by the yarn guide grooves 6'' of the yarn guide drum 6 onto the tube. The yarn guide drum 6 is driven in conventional manner by a drive shaft 6'.

Once the building of the yarn 2' onto the tube to form the cross-wound package is completed, the tube is removed from the tube support means 7 on which it is supported during the building of the package and disposed on an endless belt package transport assembly 10 for transport to a location for further handling. As seen in FIG. 1, a completed cross-wound package 8 includes a tube 9.

In accordance with the present invention, a method and apparatus is provided for associating information relating to the characteristics of a package, such as the cross-wound package 8, with the package itself and for accessing the associated information for use of the information in determining and controlling further handling of the package. As seen in FIG. 1, the package information apparatus of the present invention includes a control unit 11 such as, for example, a conventional computer. The control unit 11 is connected via a connector 5' to the yarn break monitor 4 for receiving information from the yarn break monitor concerning the travel of the yarn 2' therethrough. Additionally, the control unit 11 is connected via connectors 5'', 5''' to the yarn break monitors of the other winding stations of the machine 1. Accordingly, the information received from the respective yarn break monitors of the stations is processed by the control unit 11 and this information relates to characteristics of the cross-wound packages 8 produced at the spinning station such as, for example, the quality of the yarn of the packages.

In addition to receiving and processing information individually relating to the cross wound packages 8, the control unit 11 controls the operation of the package information apparatus of the present invention to associate the individual package information with each package. In accordance with the present invention, the individual package information is associated with each cross-wound package 8 such that it can be readily accessed at a subsequent location by the package information apparatus for processing of the information to determine and control further handling and the like of the cross wound package.

The type of individual package information associated with a package can include, for example, information concerning the origin of the package, the time and date of production of the package, the machine number of the machine which produced the package, the batch number, the package transport route, the storage destination, the transfer destination, the fiber material, the yarn number, the yarn length, the package dimensions, the conicity, the package thickness, the package weight and the number of yarn breaks which occurred during the building of the package. Additionally, the information can include quality characteristics, the quality category of the package and the further handling category of the package.

The endless belt package transport assembly 10 is connected by a connector 12 to the control unit 11 and includes a drive roller 10' drivingly connected by a drive mechanism 25 to a motor 26 for driving operation of an endless belt trained around the drive roller 10'. The control unit controls the operation of the endless belt package transport assembly to effect transport of the cross-wound packages 8 from their respective stations to a position A for individually associating information with respect to each package with the respective package. In this regard, the endless belt package transport assembly 10 includes a conventional package transfer device (not shown) for transferring each cross wound package 8 from the tube support member 7 of the respective station to the endless belt for transport to the position A. To control operation of the endless belt package transport assembly 10 to effect positioning of each cross wound package 8 in the position A, a conventional sensor 22 is positioned adjacent the endless belt of the package transport assembly 10 for sensing movement of the endless belt and is connected via connector 23 to a belt control unit 21. The belt control unit 21 is connected via a connector 24 to the belt drive mechanism 25. A package arrival sensor 19 of conventional construction is connected via connector 20 to the belt control unit 21. Accordingly, the belt control unit 21 controls the sensor 22 via the connector 23 to sense the extent of the travel of the endless belt therepast during the transport by the endless belt of a cross-wound package 8 from its respective station to the position A.

When a cross-wound package 8 arrives at the position A, the sensor 19 senses the presence of the package and signals the belt control unit 21 via the connector 20 to cease the driving operation of the endless belt. The belt control unit 21 responds to the signal from the sensor 19 by signaling the endless belt drive mechanism 25 via the connector 24 to cease driving operation of the belt. Additionally, the belt control unit 21 queries the sensor 22 to receive information concerning the extent of the endless belt travel. For example, the sensor 22 can be configured to sense the travel therepast of uniformly spaced markings along the extent of the endless belt of the package transport assembly 10.

The belt control unit 21 directs the sensor 22, which is connected by a connector 29 to the control unit 11, to transmit the endless belt travel information to the control unit 11. The control unit 11 processes the endless belt travel information to determine the particular station from which the cross-wound package 8 in the position A was produced.

Upon determining the particular station at which the cross-wound package 8 in the position A was produced, the control unit 11 transmits the information it had previously stored concerning the production and characteristics of the cross-wound package 8 to a means for inputting information into the memory chip including a memory chip encoding device for encoding the information on a memory chip. As seen in FIG. 1, the memory chip encoding device includes a memory chip magazine 14 connected via a connector 13 to the control unit 11 and a chip encoding apparatus 16 connected via a connector 15 to the control unit 11. In response to a signal via the connector 13 from the control unit 11, the memory chip magazine 14 positions a memory chip 38, which includes a conventional electronic chip having the capacity to selectively store and release encoded information and a mounting backing on which the chip is fixedly mounted, in an encoding position with respect to the chip encoding means 16 for encoding of the package information thereon in conventional manner.

Once the chip encoding device 16 has encoded the individual package information relating to the cross-wound package 8, which is positioned in the position A, onto the memory chip 38, the memory chip is ready to be mounted to the cross wound package 8. For this purpose, the present invention provides a chip transfer device 17 rotatably mounted to the frame of the machine 1 and connected by a connector 18 to the control unit 11 for operational control of the chip transfer device. The chip transfer device 17 includes a chip receptacle 17' which is positionable by the chip transfer device 17 in a receipt position below the memory chip magazine 14 for receiving the memory chip 38 when it is discharged from the memory chip magazine. Once the chip receptacle 17' has received the memory chip 38 therein, the chip transfer device 17 is controlled by the control unit 11 to pivot to bring the chip transfer device into the broken line position shown in FIG. 1.

The chip transfer device 17 includes a suction conduit (not shown) extending from the chip receptacle 17' to a means for applying a suction (not shown). Accordingly, when the chip receptacle 17' receives the memory chip 38 therein, the control unit 11 actuates the suction production means to apply suction against the memory chip which acts to retain the memory chip 38 within the chip receptacle 17' during the movement of the chip transfer device 17 to its chip discharge position shown in the broken lines in FIG. 1. The chip receptacle 17' is configured such that it does not otherwise restrain the memory chip 38 when the chip transfer device 17 is in its chip discharge position other than via the suction action applied through the suction conduit in the chip transfer device 17.

Figures 2, 3, 4, 5:
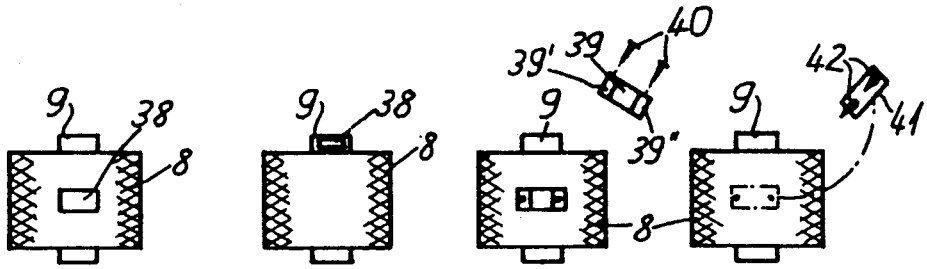
FIG. 2 is a front elevational view of a textile package bearing a memory chip for use with the package information apparatus of FIG. 1, showing the memory chip installed on the windings of the package.
FIG. 3 is a front elevational view similar to FIG. 2 showing the memory chip installed on the tube of a package.
FIG. 4 is a front elevational view similar to FIG. 2 showing the memory chip installed on the windings of a package and an exploded perspective view of the memory chip prior to installation on the package.
FIG. 5 is a front elevational view similar to FIG. 2 showing in perspective the memory chip and means for securing the memory chip to a package in solid lines and showing the memory chip, in phantom lines, as installed on the package.

The securement of the memory chip 38 to the cross-wound package 8 can be accomplished in several different ways, as illustrated in FIGS. 2–5. In FIG. 2, the memory chip 38 is secured to the winding of the cross-wound package 8 by an appropriate securement means such as, for example, an adhesive of sufficient strength to adequately fixedly secure the memory chip 38 to the windings without tearing or otherwise damaging the windings when the memory chip 38 is removed therefrom. This is the means by which the memory chip 38 illustrated in FIG. 1 is secured to the cross-wound package 8 in the position A. In FIG. 3, the memory chip 38 is secured to the tube 9 of the cross wound package 8 by appropriate securement means such as, for example, adhesive means. In FIG. 4, a memory chip 39 includes a pair of openings 39', 39'', each formed at a respective end of the memory chip mounting backing, for receipt therein of an elongated element 40 such as, for example, a pin. The mounting backing in the area of the openings 39', 39'' are free of any electronic elements. As can be understood, the elongated elements 40 are inserted through the openings 39', 39'' into the windings of the cross-wound package 8 to secure the memory chip 39 to the windings of the package. In FIG. 5, a memory chip 41 has a pair of pins 42, each permanently secured at a respective end portion of the memory chip. The memory chip 41 is secured to the windings of the cross-wound package 8 by insertion of the pins 42 into the windings.

Once the chip transfer device 17 has transferred the memory chip 38 to the chip discharge position, the memory chip is secured to the package 8 by appropriate means such as, for example, one of the securement means illustrated in FIGS. 2–5. During the securement of the memory chip to the cross-wound package 8, the suction applied to the memory chip 38 through the chip transfer device 17 is ceased. Once the memory chip 38 has been transferred to the cross-wound package 8, the control unit 11 controls the chip transfer device 17 to return to its chip receipt position (illustrated in solid lines in FIG. 1) in preparation for the receipt of another memory chip in the chip receptacle 17'.

The securement of the memory chip 38 to the cross-wound package 8 in the position A insures that the individual information concerning the characteristics of the package, which is encoded and stored in the memory chip 38, is individually associated with the package. With the memory chip 38 secured thereto, the cross-wound package 8 is ready for transport to a location for further handling.

In accordance with the present invention, a means for accessing the information stored on the memory chip 38 in a non-contacting manner with the memory chip is provided for accessing the stored information while the package is en route to a location for further handling so that the information can be used to determine the most effective handling for the package. As illustrated in FIG. 1, a package reorienting device 30 includes a right-angled arm having a post 31 mounted at its free end, a shaft 33 mounted to the other end of the right-angled arm, a shaft rotating mechanism 32' for rotating the shaft 33, a shaft 32 interconnecting the shaft rotating mechanism 32' with a motor 27 and a connector 28 extending from the motor 27 to the control unit 11. The motor 27 is fixedly mounted to the machine 1 such as, for example, by mounting to the housing of the drive mechanism 25.

Figure 6:
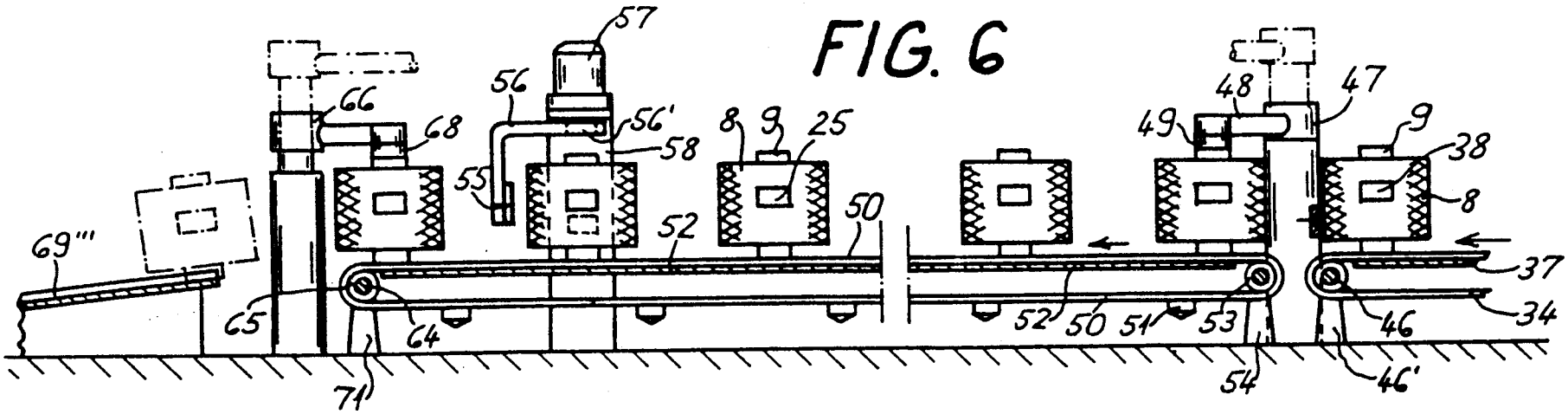
FIG. 6 is a front elevational view of a portion of a package transport assembly of a textile winding machine including one form of the accessing means and the relative positioning means of the package information of the preferred embodiment of the present invention.
Figure 7:
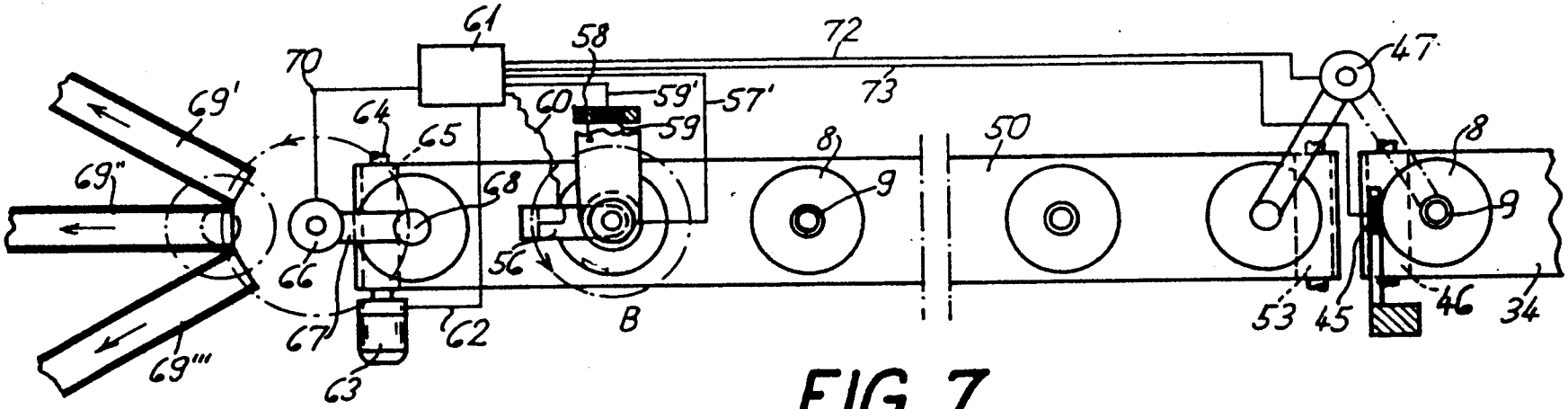
FIG. 7 is a plan view of the apparatus shown in FIG. 6.

As seen in FIGS. 1, 6 and 7, an intermediate endless belt transport assembly 34 is provided for receiving a package from the package reorienting device 30 and transporting the package to a location for accessing the information stored in the chip 38. The transport assembly 34 includes an endless belt supported along its top run by a rigid plate 37 and trained around a drive roller 36 and, as seen in FIG. 6, an end roller 46 rotatably supported on a post 46'. The intermediate endless belt transport assembly 34 additionally includes a motor 35 operatively connected to the drive roller 36 for driving the endless belt in the direction shown by the arrow in FIG. 1.

In operation, the package reorienting device 30 is controlled by the control unit 11 to transfer the cross-wound package 8 from the position A to the intermediate endless belt transport assembly 34. The control unit 11 controls the motor 27 by the connector 28 to axially extend the shaft 32 to effect insertion of the post 31 into the tube 9 of the cross-wound package 8. In this respect, the right-angled arm of the package reorienting device 30 is moved from the broken line position shown in FIG. 1 to the solid line position shown in FIG. 1 in which the post 31 is inserted into one end of the tube 9. Thereafter, the motor 27 is controlled by the control unit 11 to rotate the shaft 32 to effect rotation of the shaft rotating mechanism 32' about the axis of the shaft 32. Additionally, the shaft rotating mechanism 32' is actuated to rotate the right angled arm via rotation of the shaft 33. Through the coordinated rotation of the package reorienting device 30 about its shafts 32, 33, the package reorienting device 30 reorients the cross-wound package to a position in which it is supported on one end of its tube 9 on the endless belt of the intermediate endless belt transport assembly 34.

As noted above, the present invention provides accessing means for accessing the stored information in the memory chip 38 during transport of the cross wound package 8 to a location for further handling. To this end, there is provided a package gripper device 47 having an arm 48 with a post 49 projecting from its free end. The arm 48 is mounted at its other end to an extensible shaft means for rotation of the arm 48 about the axis of the extensible shaft means and for vertical movement of the arm 48 in the direction of the axis of the extensible shaft means. An access transport assembly 50 includes an endless belt trained around a roller 53 supported on a support post 54 and a drive roller 65 supported on a support post 71, as shown in FIG. 6, and supported along its top run by a rigid plate 52. The endless belt of the access transport assembly 50 includes a plurality of uniformly spaced posts 51 configured for insertion of the tubes 9 of the cross-wound packages 8 thereon for supporting the packages during their transport by the accessing transport assembly 50. As seen in FIG. 7, a drive motor 63 includes a drive shaft 64 to which the drive roller 65 is operatively connected for driving rotation of the drive roller 65 to drive the endless belt in the direction shown by the arrow in FIG. 6. The endless belt of the accessing transport assembly 50 is slightly spaced from the endless belt of the intermediate endless belt transport assembly 34 and the package gripper device 47 is positioned proximate these two respective endless belt positions for transferring packages from one endless belt to the other. Additionally, a second package gripping device 66, which is similarly configured to the package gripping device 47, is positioned proximate the other end of the endless belt of the access transport assembly 50.

The second package gripping device 66 includes an arm mounted to an extensible shaft means and projecting at right angles thereto. The arm includes a post 68 projecting from its free end for insertion into the tube 9 of a package for gripping the package and the extensible shaft means is extendable along its axis and rotatable about its axis to effect movement of a package gripped by the post 68.

As seen in FIGS. 6 and 7, a memory chip reading device 58 includes a step motor 57 mounted on a post extending adjacent the endless belt of the access transport assembly 50, a right-angled arm 56 and a conventional chip reader 55. The step motor 57 includes a drive shaft 56'. The right-angled arm 56 is mounted adjacent one free end to the drive shaft 56' for rotation of the right-angled arm 56 about the axis of the drive shaft 56'. The chip reader 55 is adapted to electronically or magnetically "read" the information encoded in the memory chip 38.

As seen in FIG. 7, an initiator device 45 is positioned adjacent the endless belt of the intermediate endless belt transport assembly 34. A plurality of discharge ramps 69', 69'' and 69''' are positioned adjacent the second gripper device 66 for receipt of cross-wound packages transferred thereto by the second gripper device 66.

An access control unit 61 is connected by a connector 72 to the gripper device 47; by a connector 73 to the initiator device 45; by a connector 57' to the accessing means 58; by a connector 59' to the sensor 59; by a connector 62 to the drive motor 63; and by a connector 70 to the second gripper device 66. The access control unit 61 operates to control the relative movement of the cross-wound packages 8 and the accessing means 58 to effect positioning of the memory chip 38 and the accessing means 58 within a reception area of predetermined size and direction in which the chip reader 55 and the memory chip 38 can cooperatively operate with one another for accessing the information stored in the memory chip 38.

In operation, the cross-wound package 8 is transported by the endless belt of the intermediate endless belt transport assembly 34 and, during transport therealong, the package 8 contacts the initiator device 45 adjacent the end of the endless belt of the assembly 34. The initiator device 45 then operates in conventional manner to generate a signal indicating contact by the cross-wound package 8 which is transmitted via the connector 73 to the access control unit 61. Additionally, the initiator device 45 prevents the cross-wound package 8 from traveling further under the urging of the endless belt of the intermediate endless belt transport assembly 34. Upon receipt of the signal from the initiator device 45 indicating contact by the cross-wound package 8, the access control unit 61 signals the gripper device 47 via the connector 72 to engage the tube 9 of the cross-wound package 8. The gripper device 47 is controlled to insert its post 49 into the top of the tube 9 for engaging the cross-wound package 8 for transfer by the gripper device 47 from the intermediate endless belt transport assembly 34 to the access transport assembly 50. To this end, the post 49 can be provided, for example, with radially outwardly movable projections for engaging the inner surface of the tube 9. Once the post 49 has engaged the tube 9, the gripper device 47 is controlled to rotate the arm 48 with respect to the axis of the extensible shaft member to dispose the cross-wound package 8 in a position overlying the endless belt of the access transport assembly 50. Thereafter, the extensible shaft member of the gripper device 47 is axially lowered to effect depositing of the tube 9 of the cross-wound package 8 onto one of the posts 51 of the endless belts of the access transport 50. The post 49 is then operated to release its gripping engagement with the tube 9.

With the cross-wound package 8 now supported on one of the posts 51, the endless belt of the access transport assembly 50 is operated to move the package in the direction shown by the arrow in FIG. 6. As the cross-wound package 8 arrives at the position B, shown in FIG. 7, the sensor 59 senses the presence of the package and signals the access control unit 61 via the connector 59'. The access control unit 61 then controls the endless belt drive motor 63 via the connector 62 to cease driving movement of the endless belt whereby the cross-wound package 8 is supported in a stationary position at the position B by the endless belt of the access transport assembly 50. Thereafter, the access control unit 61 controls the operation of the step motor 57 via the connector 57' to effect rotation of the right-angled arm 56 about the axis of the drive shaft 56'. The rotation of the right-angled arm 56 effects movement of the chip reader 55 in the annular path illustrated in broken lines in FIG. 7.

When the chip reader 55 enters the reception area in which it can access the stored information on the memory chip 38, a signal is transmitted by the chip reader 55 via the connector 60 to the access control unit 61 which thereupon deactivates rotation of the right-angled arm 56. The chip reader 55 is then controlled by the access control unit 61 to access the stored information in the memory chip 38 and this information is transmitted to the access control unit 61 for storage therein. The access control unit 61 processes the information received from the chip reader 55 to control the further handling of the package 8 such as, for example, to control the operation of the second gripper device 66 to transfer the cross-wound package 8 to one of the ramps 69', 69'' or 69'''. Specifically, once the chip reader 55 has completed its accessing operation of the memory chip 38, the access control unit 61 controls the rotation of the right-angled arm 56 to move the arm to a clearance position in which the cross-wound package 8 can be moved therepast by the endless belt of the access transport assembly 50. The endless belt drive motor 63 is then controlled by the access control unit 61 to advance the cross-wound package to a position adjacent the end of the endless belt for engagement by the second gripper device 66.

The access control unit 61 controls the movement of the second gripper device 66 in response to the information originally stored on the memory chip 38 and processed by the access control unit 61. For example, the access control unit 61 can be loaded with tolerance limits relating to predetermined further handling classifications for the cross-wound packages and, in accordance with a determination by the access control unit 61 concerning the appropriate classification of the particular cross-wound package 8 engaged by the second gripper device 66, the access control unit 61 can control the second gripper device 66 to transfer the engaged cross-wound package 8 to a selected one of the discharge ramps 69', 69'' or 69'''. In this transfer operation, the second gripper device 66 operates in a manner similar to the gripper device 47. The post 68 is provided, for example, with conventional radially outwardly expandable projections to engage the inner surface of the tube 9 so as to securedly grip the cross wound package 8 for transfer movement. The extensible shaft member of the second gripper device 66 is vertically movable and rotatable about its axis to effect movement of the cross-wound package 8 from the access transport assembly 50 to the selected one of the discharge ramps 69', 69'' and 69'''.

The present invention also contemplates that the chip reader 55, in addition to its chip reading configuration, can be configured as an encoding device operating similarly to the encoding device 16 discussed with respect to FIG. 1 down line for reading of the chip by a chip reader. In this configuration, the chip reader 55 includes the capability to rearrange or otherwise change the information initially encoded on the memory chip 38 or to supplement that information.

Figure 11:
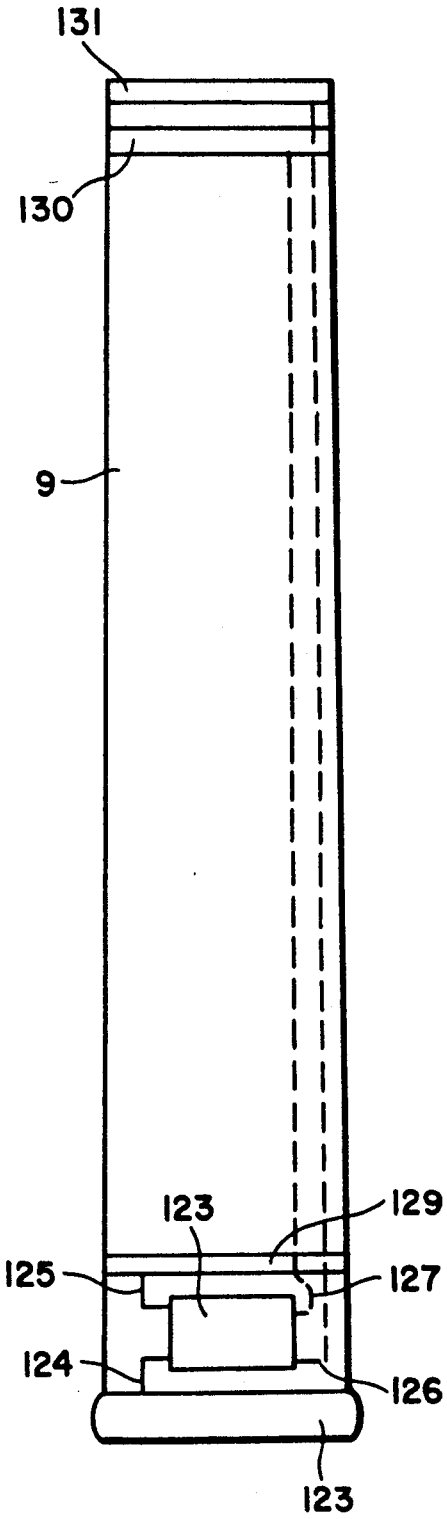
FIG. 11 is a front elevational view of the tube of a textile packaging bearing a memory chip according to the present invention.
Figure 12:
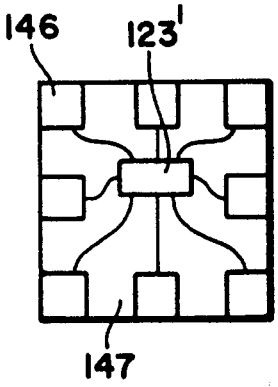
FIG. 12 is a schematic view of the memory chip shown in FIG. 11.

In FIGS. 11 and 12, another arrangement for securing a memory chip to a package is illustrated. As seen in FIG. 11, a tube 9 of the package is provided with a pair of annular, spaced contact members 128, 129 extending around the periphery of the lower axial portion of the tube and a pair of annular, spaced contact members 130, 131 extending around the periphery of the upper axial portion of the tube. A memory chip assembly 123 is mounted to the lower axial portion of the tube 9 between the lower contact members 128, 129 and is connected via a connector 126 to the contact member 131, via a connector 127 to the contact member 130, via a connector 124 to the contact member 128, and via a connector 125 to the contact member 129. With reference now to FIG. 12, the memory chip assembly 123 includes eight contact surfaces 146 spaced about the periphery of a generally square galvanic conductor plate 147 and all commonly connected to a conventional electronic memory chip 123' in the form of a flexible plate, known commercially as a "micropack," and mounted centrally to the conductor plate 147. Alternatively, the memory chip 123' can be in the form of an electronically extinguishable write-read memory chip or an extinguishable and programmable chip having a buffered RAM capability.

Figure 13:
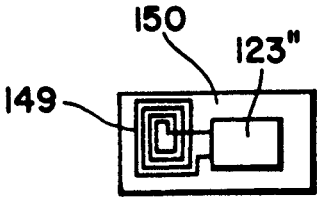
FIG. 13 is a plan view of another form of the memory chip shown in FIG. 11.
Figure 14:
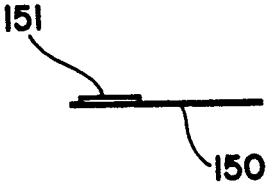
FIG. 14 is a side elevational view of the memory chip shown in FIG. 13.

The memory chip can alternatively be configured in the embodiment shown in FIGS. 13 and 14. As seen in FIGS. 13 and 14, a memory chip 123" having the capacity to receive and store encoded, extinguishable information is mounted to a flexible conductor plate 150 and is connected to a winding 149 imprinted on a ferrite plate 151 mounted on the flexible conductor plate 150.

Figure 15:
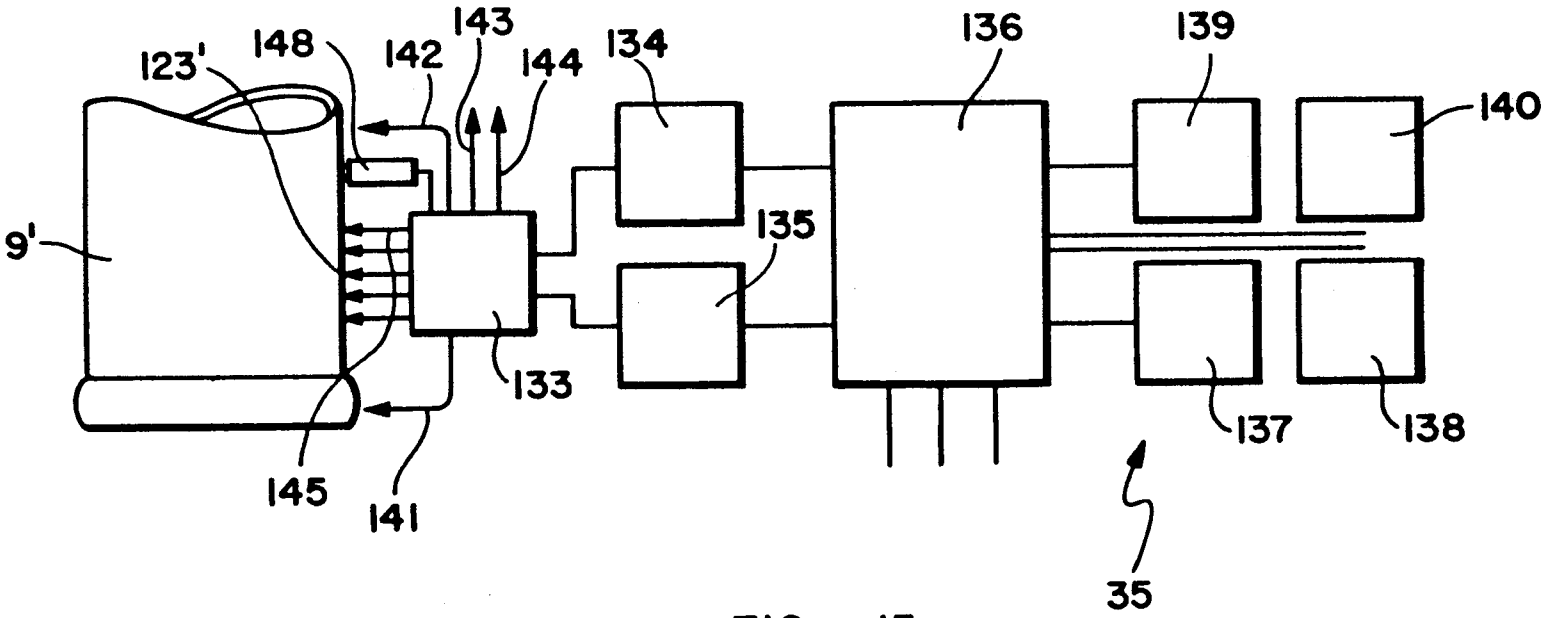
FIG. 15 is a schematic view of one form of the chip reader of the package information apparatus of the present invention.

With further reference to the chip reader 55, FIG. 15 schematically illustrates the chip reader as it is configured to access the information stored on a memory chip such as, for example, the memory chip 123' mounted on a tube 9' of a package. The chip reader 55 includes a contact unit 133 connected to an encoder 134 and a decoder 135. The encoder 134 and the decoder 135 are connected to a central processing unit (CPU) 136. A printer 137, a monitor 138, a keyboard 139 and a memory unit 140 are also connected to the central processing unit 136. The contact unit 133 includes four sliding contacts 141–144, each sliding contact being adapted to contact one of the contact members 128–131 mounted on the tube 9'. Additionally, the contact unit 133 includes a plurality of needle-like contact pins 145, each contact pin being positioned to contact one of the eight contact surfaces 146 on the memory chip 123. The chip reader 55 additionally includes a transceiver winding 148 adapted to interact with the imprinted winding 149 in a non-contacting manner such as, for example, by interacting inductively across a relatively large air space therebetween.

In FIGS. 8–10, an alternative configuration of the means for moving the package and the accessing means relative to one another and of the means for controlling the relative movement of the package and the accessing means are illustrated. An access transport assembly 82 includes an endless belt trained around a roller 80 and a drive roller 101 and supported along its top run by a rigid plate. The endless belt is adapted to convey a plurality of package support plates 78. As best seen in FIG. 9, each package support plate 78 includes a vertical post 79 mounted on a pedestal base 79' and the pedestal base 79' is rotatably mounted on a rotation post 111 projecting vertically from a ground plate 78'. The vertical post 79 and the base pedestal 79' are rotatable as one unit about the axis of the rotation post 111. The vertical post 79 is configured to be relatively snugly received within the lower axial inner portion of a tube 9 of a cross-wound package 8 inserted thereon and the base pedestal 79' is adapted to support the tube 9 thereon.

The package support plates 78 are supported on the endless belt of the access transport assembly 82 but are not fixedly connected to the endless belt. The endless belt is continuously driven and the package support plates 78 are conveyed thereby until the movement of the package support plates is stopped or otherwise impeded relative to the endless belt.

A plate gripping device 74 is adapted to transfer the package support plates 78 from a feed belt 77 to the endless belt of the access transport assembly 82. The plate gripping device 74 includes a pair of cooperating scissor-type arms 76 for selectively clamping the vertical post 79 of a package support plate 78 therebetween and an actuating arm 75 for selectively actuating the clamping operation of the arms 76. As the plate gripping device 74 transfers a package support plate 78 from the feed belt 77 to the endless belt of the access transport assembly 82, the plate gripping device continues to compressively engage the vertical post 79 to maintain the transferred package support plate 78 at a position in front of a sensor 81, as shown in FIG. 10, until a cross-wound package 8 has been mounted on the package support plate 78.

A sensor 81 is positioned adjacent the endless belt of the access transport assembly 82 and connected by a connector 94 to an access control unit 97. The plate gripping device 74 is connected by a connector 95 to the access control unit 97. A plate stop device includes a piston assembly including a hydraulic cylinder 102 and a piston 103 selectively extensible from, and retractable into, the hydraulic cylinder 102. The hydraulic cylinder 102 is connected via a connector 104 to the access control unit 97. The piston 103 is selectively extendable to a position transverse to the travel path of the package support plate 78 along the endless belt to prevent movement of the package support plate 78 in the advancing direction of the endless belt and is selectively retractable from the transverse position to permit travel of the package support plate 78 therepast.

A combination sensor and chip reading device 85 is positioned adjacent the endless belt of the access transport assembly 82 and is connected via a connector 86 to the access control unit 97. A means for controlling the relative movement of a cross-wound package 8 and the combination sensor and chip reader 85 includes a pair of guide arms 90', 90" commonly pivotally connected at the same respective end. The guide arm 90' includes a guide roller 90 rotatably mounted at its free end and the guide arm 90" includes a pair of guide rollers 90 rotatably mounted thereto. A drive roller 89 is rotatably mounted to the guide arm 90" and is operatively connected to one of the guide rollers 90 of the guide arm 90" for driving rotation of the guide roller. A belt 89' is trained around the drive roller 89 and around a shaft 89" of a drive motor (not shown). A motor 88 includes a drive shaft 89". The motor 88 is connected via a connector 88' to the access control unit 97, as best seen in FIGS. 8 and 10. Accordingly, the drive roller 89 is driven by rotation of the shaft 89" through the belt 89' and, in turn, the drive roller 89 drivingly rotates one of the guide rollers 90 of the guide arm 90". The guide arm 90' is connected to a linkage 92" for effecting movement of the guide arm 90' about the axis of the drive shaft 89". Similarly, the guide arm 90" is connected to a linkage 92" for effecting movement of the guide arm 90" about the axis of the drive shaft 89". Both the linkages 92', 92" are commonly connected to a drive piston 93" which is selectively extendable from, and retractable into, a conventional hydraulic cylinder 93. The hydraulic cylinder 93 is connected via a connector 93' to the access control unit 97.

The drive roller 101 which drives the endless belt of the access transport assembly 82, is drivingly connected to the shaft 99 of a drive motor 100. A shunt ramp 106 is pivotally mounted to a discharge ramp 105 positioned adjacent the driven end of the endless belt of the access transport assembly 82. The discharge ramp 105 is adapted to support the package support plates 78 which slide thereon upon reaching the end of the top run of the endless belt. The free end of a piston 107 is connected to the shunt ramp 106, as shown in FIG. 10, and the piston 107 is selectively extendable from, and retractable into, a conventional hydraulic cylinder 108 which is mounted on a support 109. The cylinder 108 is connected via a connector 98 to the access control unit 97. Under the control of the access control unit 97, the cylinder 108 and piston 107 are operable to selectively position the shunt ramp 106 at a respective one of a plurality of ramps 110', 110'' or 110''', as seen in FIG. 10.

In operation, the plate gripper device 74 is controlled by the access control unit 97 to transfer the next oncoming package support plate 78 from the feed belt 77 to the endless belt of the access transport assembly 82. The plate gripper device 74 continues to grip the transferred package support 78 while the sensor 81 signals the access control unit 97 via the connector 94 that a fresh package support plate 78 has been transferred to the endless belt. The access control unit 97 then controls a package transfer device 84 via a connector 96, to place a cross wound package 8 onto the package support plate 78 held by the plate gripper device 74. As shown in FIG. 8, the package transfer device 84 vertically moves the cross wound package 8 from a position above the package support plate 78, as shown by the broken lines in FIG. 8, to its supported position on the package support plate. Before transfer to the package support plate 78, the cross wound package 8 has previously been provided with a memory chip 79, as shown in FIG. 8, which is mounted to the package by a pair of pins 40 inserted through a pair of non-electronic end portions 39', 39'' of the memory chip.

The continuous operation of the endless belt acts to convey the package support plate 78 with the cross wound package 8 thereon, in the direction of the arrow shown in FIG. 10. The access control unit 97 controls the operation of the cylinder 102 and the piston 103 to stop the travel of the package support plates 78 as they approach the relative movement control means. Once the guide arms 90', 90'' of the relative movement control means have been retracted to a clearance position for permitting another cross wound package 8 to be moved into position adjacent the combination sensor and chip reader 85, the piston 103 is retracted into the cylinder 102 to permit the cross wound package 8 (which was just in contact with the piston 103), to advance to a position adjacent the combination sensor and chip reader 85. As the cross wound package 8 arrives at this position, the access control unit 97 controls the cylinder 93 via the connector 93' to retract the piston 93'' into the cylinder, thereby effecting movement of the guide arms 90', 90'' into cooperative positions for engaging the tube 9 of the cross wound package 8. Specifically, the guide arms 90', 90'' pivot about the drive shaft 89'' in opposite directions to bring their guide rollers 90 into three circumferentially spaced points of contact with the base pedestal 79' on which the tube 9 of the cross wound package 8 is supported. Thereafter, the access control unit 97 controls the motor 88 via the connector 88' to drivingly rotate the driven guide roller 90 to effect rotation of the base pedestal 79'. The cross wound package 8 rotates in correspondence with the rotation of the base pedestal 79' and, when the memory chip 39 is positioned within the reception area of the combination sensor and chip reader 85, the combination sensor and chip reader 85 signals the access control unit 97 via the connector 86 to control the operation of the motor 88 to de-activate rotation of the cross wound package 8. The combination sensor and chip reader 85 then accesses the information stored in the memory chip 39 and transmits the same via the connector 86 to the access control unit 97.

Once the information from the memory chip 39 has been received by the access control unit 97, the access control unit 97 controls the cylinder 93 to retract the guide arms 90', 90'' to their clearance position, thereby permitting the endless belt of the access transport assembly 82 to convey the cross wound package 8 to the end of the endless belt adjacent the discharge slide 105. As the cross wound package 8 is conveyed toward the end portion of the endless belt, the access control unit 97 determines the appropriate one of the ramps 110', 110'' or 110''' to which the cross wound package 8 should be shunted and accordingly controls the cylinder 108 via the connector 98 to position the shunt ram 106 to the selected ramp. Accordingly, as the package support plate 78 is discharged from the endless belt, it slides along the discharge slide 105, along the shunt ramp 106 and onto the selected one of the ramps 110', 110'' or 110''' for transport therealong to a location for further handling.

The present invention contemplates that the memory chip package securing and reading means of the present invention can be used with packages which have been produced, for example, by winding machines, rotor spinning machines or other textile machines. Additionally, the present invention contemplates that the memory chip can be secured to a package by any suitable appropriate securement means such as, for example, staples. Moreover, the present invention contemplates that the memory chip can be provided with one or more removal clips which do not engage the surface of the cross wound packages to which the memory chip is secured. Accordingly, during the removal of the memory chip from a package, an appropriately configured gripping apparatus can engage the removal clip of the memory chip to effect removal of the memory chip from the package and the removed memory chip can then be recycled for use on another package. It is also contemplated that the last package handling location can include means for securing a label to the packages, the label being imprinted with information previously encoded on the memory chip associated with the package.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention.

The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile machine of the type having a package of textile material disposed on a bobbin, a memory chip securable to the package for storing information associated with the package and means for accessing the information stored in the memory chip secured to the package, the accessing means being operable to access the stored information when the accessing means is located within a reception area of predetermined size and location relative to the memory chip, a manipulating apparatus comprising:

means for relatively moving the package and accessing means; and means for controlling the relative movement of the package and the accessing means to effect relative positioning of the memory chip and the accessing means to dispose the accessing means within the reception area, said means for relatively moving the package and the accessing means being deactivated upon positioning of the memory chip and the accessing means within the reception area.

2. In a textile machine of the type having a package of textile material disposed on a bobbin, a memory chip securable to the package for storing information associated with the package and means for accessing the information stored in the memory chip secured to the package, the accessing means being operable to access the stored information when the accessing means is located within a reception area of predetermined size and location relative to the memory chip, a manipulating apparatus comprising:

means for relatively moving the package and the accessing means;

means for controlling the relative movement of the package and the accessing means to effect relative positioning of the memory chip and the accessing means to dispose the accessing means within the reception area; and means for loading information in the memory chip prior to securement of the memory chip on the package.

3. In a textile machine of the type having a package of textile material disposed on a bobbin, an information storing apparatus comprising:

a memory chip having an accessible information storing portion for storing information associated with the package;

means for removably securing the memory chip to the package for subsequent removal of the chip from the package for reuse;

means for accessing the information stored in the memory chip, the accessing means being operable to access the stored information when the accessing means is located within a reception area of predetermined size and location relative to the memory chip;

means for relatively moving the package and the accessing means; and means for controlling the relative movement of the package and the accessing means to effect relative positioning of the memory chip and the accessing means to dispose the accessing means within the reception area.

4. In a textile machine, a memory chip according to claim 3 and characterized further in that said removably securing means is formed of an adhesive material.

5. In a textile machine, a memory chip according to claim 3 and characterized further in that said removably securing means includes an elongated element projecting from the chip and insertable into the textile material on the package.

6. In a textile machine, a memory chip according to claim 5 and characterized further in that said removably securing means includes a mounting component for supporting the memory chip, said mounting component including portions extending beyond the memory chip for receiving said elongated element therethrough to removably secure said mounting component to the package.

7. An apparatus for associating information with a package, the package including textile material disposed on a tube, comprising:

a memory chip securable to the package for storing information associated with the package;

means for accessing said stored information in said memory chip in a non-contacting manner while said memory chip is secured to the package; and means for inputting information into said memory chip when said memory chip is not secured to the package.

8. An apparatus for associating information with a package, the package including textile material disposed on a tube, comprising:

a memory chip securable to the package for storing information associated with the package;

means for accessing said stored information in said memory chip in a non-contacting manner while said memory chip is secured to the package; and means for inputting information into said memory chip, said inputting means including an encoding device and a decoding device, said encoding device having the capability to extinguish stored information in said memory chip and to encode additional information into said memory chip.

9. An apparatus according to claim 8 and characterized further in that said memory chip is in the form of a flexible plate.

10. An apparatus according to claim 8 and characterized further by a device mounted to the package and operatively connected to said memory chip for accessing of said stored information therethrough by a selected one of said encoding and decoding devices.

11. An apparatus according to claim 10 and characterized further in that said operatively interconnecting device includes a galvanic conductor plate having a plurality of flexible contact surfaces.

12. An apparatus according to claim 11 and characterized further in that said operatively interconnecting device includes a contact member extending peripherally around the tube.

13. An apparatus according to claim 12 and characterized further in that said peripherally extending contact member is in the form of a metal cable.

14. An apparatus according to claim 10 and characterized further in that said operatively interconnecting device includes a ferrite plate for mounting said memory chip thereon and a winding imprinted on said ferrite plate and said accessing means includes a transceiver winding adapted to interact with said winding on said ferrite plate in a non-contacting manner.

15. An apparatus according to claim 8 and characterized further in that said memory chip is in the form of an electronically extinguishable write-read memory chip.

16. An apparatus according to claim 8 and characterized further in that said memory chip is in the form of an extinguishable and programmable memory chip having a buffered RAM capability.

17. An apparatus according to claim 16 and characterized further in that said memory chip includes the capability to operate as a processor in coordination with said accessing means.

18. A method for use in a textile machine of the type having a package of textile material disposed on a bobbin, a memory chip securable to the package for storing information associated with the package, means for accessing the information stored in the memory chip in a non-contacting manner with the memory chip and means for relatively moving the package and the accessing means, comprising:

controlling the moving means to effect relative positioning of the memory chip and the accessing means in which the accessing means is disposed within a reception area of predetermined size and location for accessing of the stored information by the accessing means; and stopping the relative movement of the package and the accessing means when the accessing means is disposed within the reception area.

19. A method according to claim 18 and characterized further by directing the package to a selected of a predetermined group of further handling locations in response to the information accessed from the memory chip by the accessing means.

20. A method according to claim 19 and characterized further by removing the memory chip from the package following the accessing of the information by the accessing means.

21. A method for use in a textile machine of the type having a package of textile material disposed on a bobbin, a memory chip securable to the package for storing information associated with the package, means for accessing the information stored in the memory chip in a non-contacting manner with the memory chip and means for relatively moving the package and the accessing means, comprising:

controlling the moving means to effect relative positioning of the memory chip and the accessing means in which the accessing means is disposed within a reception area of predetermined size and location for accessing of the stored information by the accessing means; and loading the memory chip with information associated with the package and securing the memory chip to the package after the information has been loaded therein.

22. A method for use in a textile machine of the type having a package of textile material disposed on a bobbin, a memory chip securable to the package for storing information associated with the package, means for accessing the information stored in the memory chip in a non-contacting manner with the memory chip and means for relatively moving the package and the accessing means, comprising:

controlling the moving means to effect relative positioning of the memory chip and the accessing means in which the accessing means is disposed within a reception area of predetermined size and location for accessing of the stored information by the accessing means; and removing the memory chip from the package following the accessing of the information by the accessing means.

* * * * *